US009228802B2

(12) United States Patent
Ribas

(10) Patent No.: US 9,228,802 B2
(45) Date of Patent: Jan. 5, 2016

(54) UNIVERSAL HOLSTER ASSEMBLY

(71) Applicant: Augusto Ribas—Serviços, Part. e Empreendimentos Ltda., Rio de Janeiro (BR)

(72) Inventor: Augusto Sérgio de Oliveira Ribas, Rio de Janeiro (BR)

(73) Assignee: Augusto Ribas-Servicos, Part. E Empreendimentos Ltda., Rio de Janeiro (BR)

( * ) Notice: Subject to any disclaimer, the term of this patent is extended or adjusted under 35 U.S.C. 154(b) by 294 days.

(21) Appl. No.: 13/862,928

(22) Filed: Apr. 15, 2013

(65) Prior Publication Data

US 2014/0305975 A1 Oct. 16, 2014

(51) Int. Cl.
*F41C 33/02* (2006.01)

(52) U.S. Cl.
CPC ..... *F41C 33/0263* (2013.01)

(58) Field of Classification Search
CPC . F41C 33/0263; F41C 33/0227; F41C 33/045
USPC ..... 224/192, 193, 198, 244, 911, 912
See application file for complete search history.

(56) References Cited

U.S. PATENT DOCUMENTS

| | | | | |
|---|---|---|---|---|
| 5,421,497 | A * | 6/1995 | Gilmore | 224/198 |
| 5,598,958 | A * | 2/1997 | Ryan et al. | 224/198 |
| 5,810,221 | A * | 9/1998 | Beletsky et al. | 224/244 |
| 6,415,541 | B1 * | 7/2002 | Rassias | 42/70.11 |

* cited by examiner

*Primary Examiner* — Corey Skurdal
(74) *Attorney, Agent, or Firm* — Fitch, Even, Tabin & Flannery LLP

(57) ABSTRACT

A holster assembly for a handgun includes a double-locking system that comprises two distinct and independent locking devices. A first passive locking device is actuated by the weight of the gun, upon its insertion into the holster, and a second passive locking device is actuated by a spring. An active locking device is also provided that further secures the handgun to the holster to avoid inadvertent removal or discharge of the handgun. The active locking device is movable between a plurality of positions to provide varying degrees of securement for the handgun to the holster. The holster assembly further includes a height-regulating system to adjust the height of the assembly with respect to the user's body.

5 Claims, 4 Drawing Sheets

UNIVERSAL HOLSTER ASSEMBLY

FIELD OF THE INVENTION

The present invention relates generally to firearm holsters, and more particularly to a universal holster assembly with a double-locking system and other features that may be used with virtually any type of handgun.

BACKGROUND OF THE INVENTION

It is known to provide handgun holsters with replaceable inserts or parts that allow the holsters to adapt to different gun models. However, the need for separate parts to adapt a holster is sometimes inconvenient.

Therefore, it would be desirable to provide a holster design that enables a ready and simple adaptation of the holster to a wide range of gun models.

SUMMARY OF THE INVENTION

In view of the foregoing, it is an object of the present invention to provide a universal holster assembly with all of the functionalities and features of the prior art holsters. In particular, by means of the present invention, it is possible to encompass virtually any kind of handgun and thereby dramatically reduce manufacturing costs, because there is no risk of obsolescence.

According to an embodiment of the present invention, a holster assembly includes a double-locking system that comprises two distinct and independent locking devices. A first active locking device is actuated by a spring, and a second passive locking device is actuated by the weight of the gun, upon its insertion into the holster, and by the user wearing the holster by means of a lever. This feature ensures complete safety when wearing the assembly.

According to a further embodiment of the present invention, a holster assembly includes a height-regulating system to adjust the height of the assembly with respect to the user's body. Said height-regulating system allows the holster assembly to be released from the strap by which it is attached to a belt, while the strap remains coupled to the belt. This feature has at least two advantages over prior-art assemblies: firstly, it allows size (volume) reduction of the belt during storage; and, secondly, with the use of a special cover, the gun may be placed into the holster and locked, the whole assembly being then covered with the cover and safely removed from the belt. Safety is secured by the fact that the assembly is totally covered, as well as due to the trigger-locking function performed by the holster that prevents inadvertent firing.

These and other objects, aspects and advantages of the present invention will be better appreciated in view of the drawings and following detailed description of a preferred embodiment.

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims. Furthermore, skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION OF A PREFERRED EMBODIMENT

Figure 1:
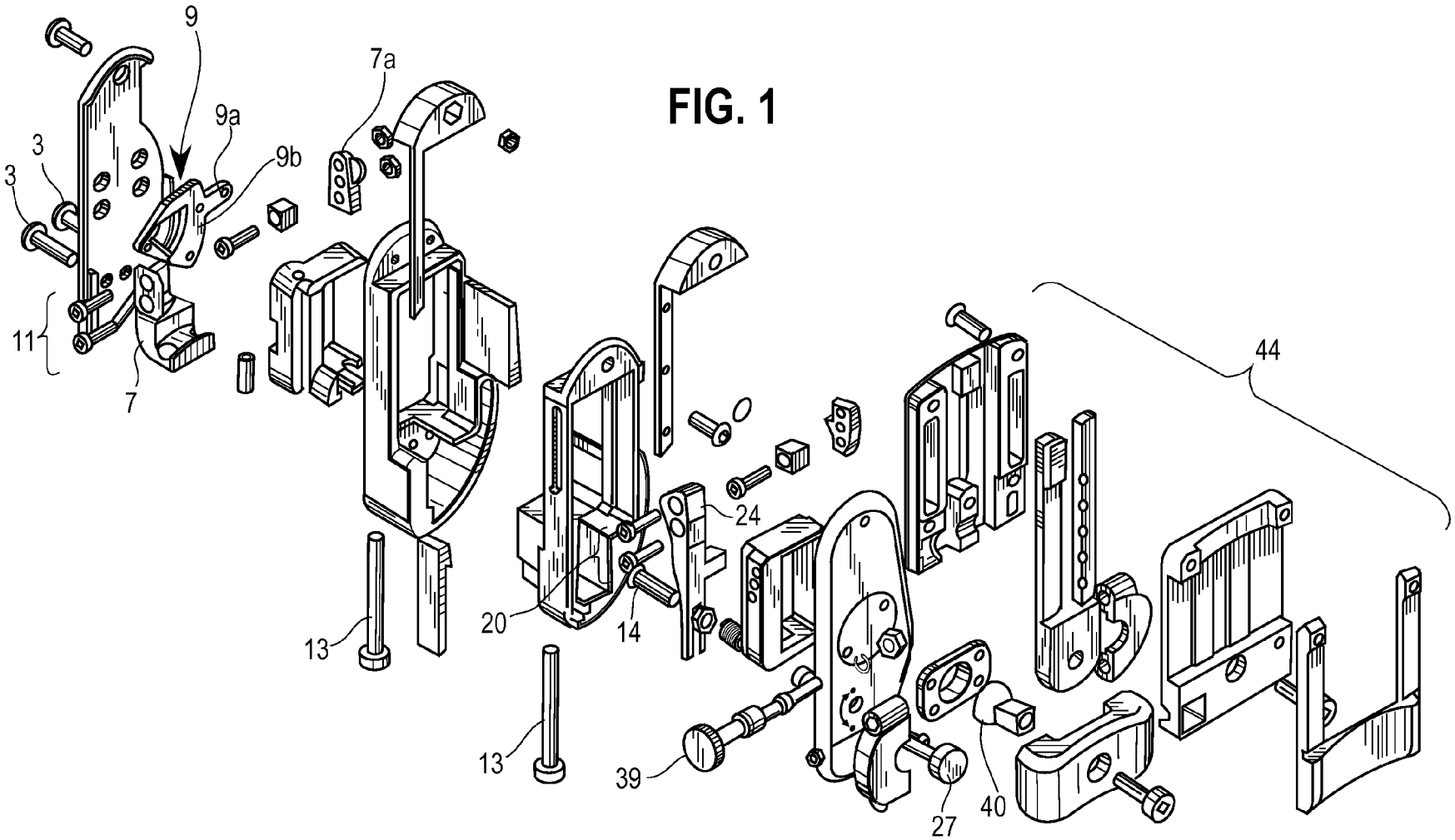
FIG. 1 is an exploded view of a preferred embodiment of the universal holster assembly according to the present invention.
Figure 2A:
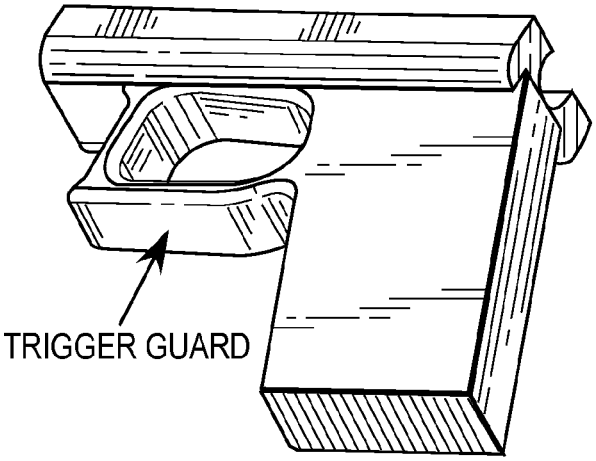
FIGS. 2A-C are perspective, side elevation and front elevation views, respectively, illustrating the trigger guard dimensions of a firearm that may be used in accordance with the invention to determine different regulations of or settings for the holster assembly of FIG. 1.
Figure 2B:
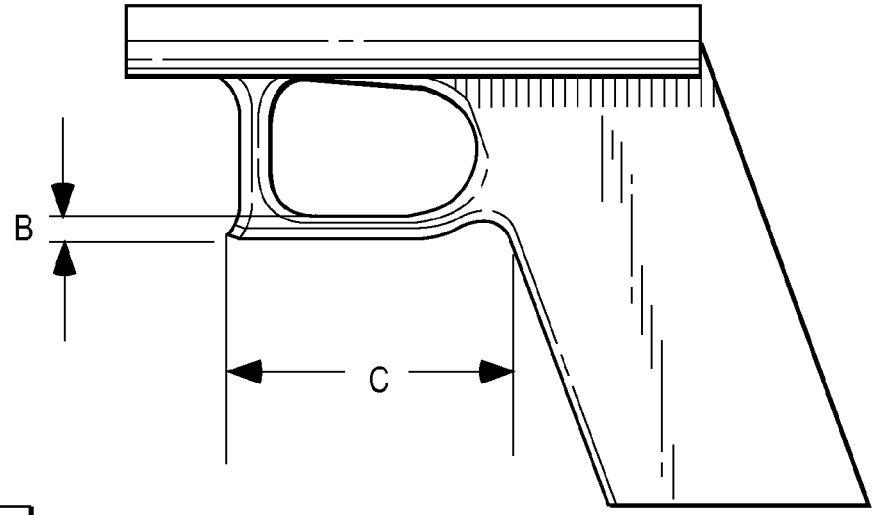
Figure 2C:
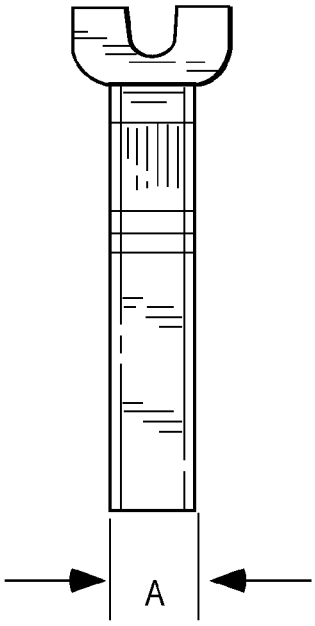

Referring to FIGS. 1-3D, the adjustment of the universal holster assembly to a specific gun depends on the dimensions A, B and C of the gun's trigger guard, as shown in FIGS. 2A-C.

The adjustment with respect to dimension A in FIG. 2C is done by tightening or loosening screws 3 and the knob of threaded shaft 27 (FIG. 3) which widens or narrows the width between lock members 7 and 24, respectively. In this way, the lock members 7 and 24 may be adjusted to fit trigger guards of different sizes so that the holster can accommodate different makes or types of firearms (e.g., trigger guards of different widths). Thus, screws 3 and shaft 27 form threaded engagements that allow the clamping width of the lock member 7 and 24 to be adjusted.

Height regulation or the adjustment with respect to dimension C in FIG. 2B is achieved by means of the screws 13 on the bottom part of the holster assembly and, specifically, by tightening or loosening screws 13. When screws 13 are turned, the set of locks 7 and 24 (FIG. 3) are moved such as to encompass every size of commercially available trigger guards. In the form illustrated, this adjustment is made primarily to accommodate for varying thicknesses of the front of the trigger guard so that locks 7 and 24 will properly engage this portion of the trigger guard and securely hold the trigger guard when a firearm is placed in the holster.

Fine adjustments may be made to screws 3 and threaded shaft 27 to make sure that the first and second lock members 7 and 24 advance forward toward the inside of the trigger guard trigger opening in order to properly secure the firearm once it is inserted into the holster.

Together the first and second passive lock members 7 and 24, seen in FIG. 3, allow withdrawal or removal of the firearm without the firearm or gun falling from the holster, even when the active lock 9 (which will be discussed further below) is disengaged or in its unlocked position. The withdrawal enabled by passive lock members 7 and 24 may be adjusted according to the user's preferred style, i.e., by turning the knob end of threaded shaft 27 in the (+) (clockwise) direction, withdrawal is "heavier" meaning it requires more force to pull the firearm out of the holster, whereas tuning knob 27 in the (−) (counterclockwise) direction enables a "looser" withdrawal meaning it requires less force to pull the firearm out of the holster. In the form illustrated, the knob of threaded shaft 27 is positioned at the rear or hidden side of the holster between the holster body and belt clip 44 so that it is shielded from being inadvertently bumped or moved (which could happen if the shaft knob was positioned on the front or exposed side of the holster).

Figure 3A:
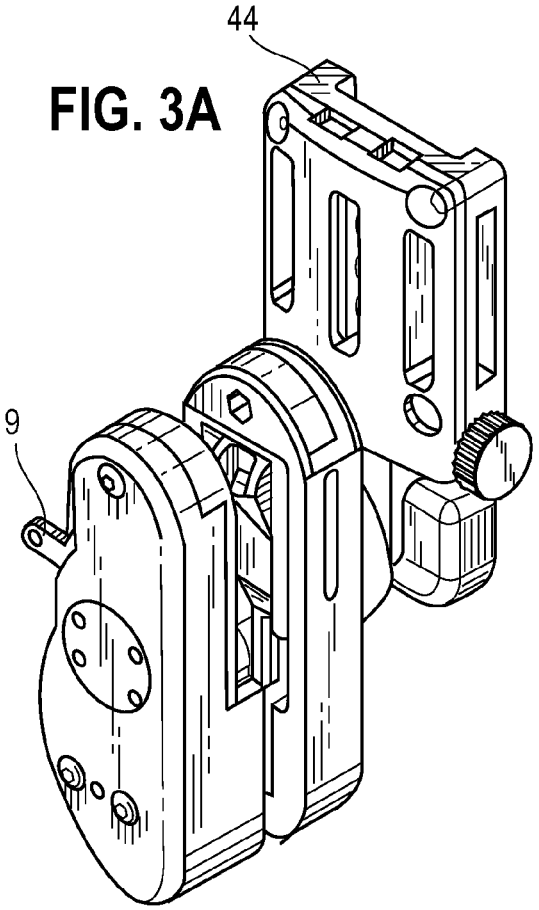
FIGS. 3A-D are perspective, side, front and bottom views, respectively, of the universal holster assembly of FIG. 1.
Figure 3B:
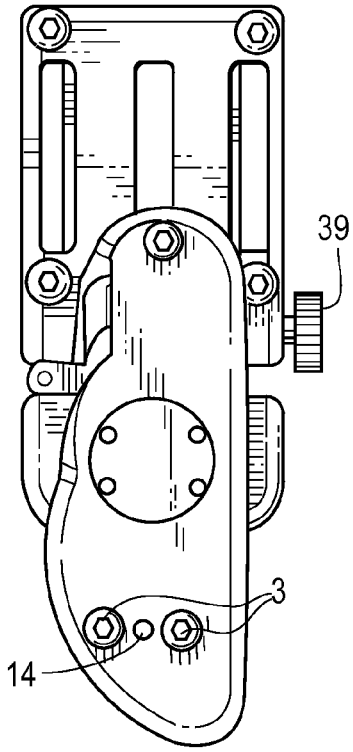
Figure 3C:
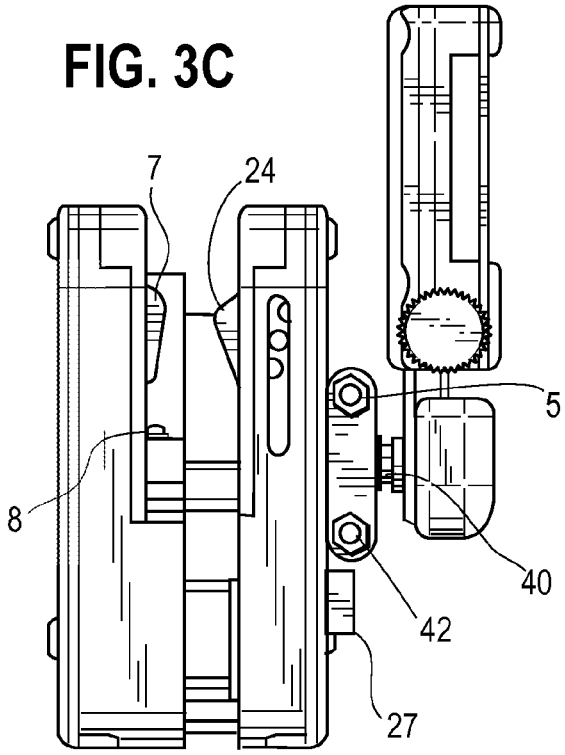
Figure 3D:
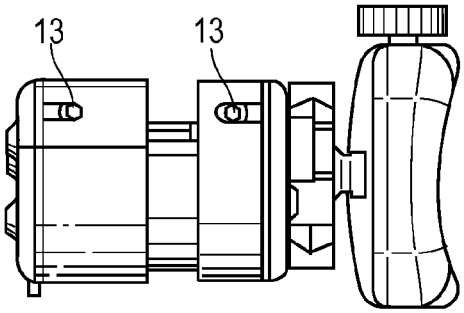

Regarding dimension B, both the first and second passive locks 7 and 24 comprise movable inserts 7*a* and 24*a*, respectively, that may be adjusted until they touch the inside of the trigger guard or at least capture the front of the trigger guard to secure the firearm in the holster without giving the firearm too much, if any, play so that the firearm does not rattle or move while in the holster. In order to adjust passive lock 7, the lock 7 must be moved forward until adjustment screws 11 (FIG. 1) are exposed. Such an adjustment is made by unscrewing the outward screws 3. Likewise one adjusts the movable insert 24*a* of second passive lock 24 by rotating knob 27 until adjustment screws 20 (FIGS. 1 and 3) are exposed, with the only difference being that the second lock 24 has to be aligned with a lateral void in the holster body housing in order to provide access to the adjustment screws 20. In the form shown, knob 27 would be tightened or loosened until the screws that connect insert 24*a* to lock 24 are visible through the lateral void (as illustrated in FIG. 3C).

The first passive lock 7 is activated by the weight of the firearm (e.g., pistol or gun) so that as the firearm is placed in the holster the downward force exerted on lock member 7 by the weight of the firearm pivots the insert 7*a* into engagement with the trigger opening and, in particular, the front of the trigger guard. The second passive lock member 24 is spring actuated as illustrated in FIG. 1 so that a spring positioned about internally threaded sleeve 14 biases the locking member 24 into engagement with the trigger opening and front of the trigger guard. Thus, passive locks 7 and 24 allow a complete and first means for locking the pistol to the holster in such a way that the firearm may be readily removed whenever desired simply by pulling the firearm out of the holster.

In the form illustrated, a second active lock is also provided that allows the firearm to be further secured to or in the holster. By actuation of the locking lever 9 (FIGS. 1 and 3), withdrawal of the firearm from the holster becomes impossible, which further increases safety when drawing the pistol is not necessary or desired. More particularly, in the form shown, locking lever 9 can be rotated between 3 positions. The first position (position 1) is where the handle 9*a* of locking lever 9 is in its most upright position with respect to the remainder of the holster and the body 9*b* of locking lever 9 does not engage or interfere with any portion of lock member 7. The second position is when the handle 9*a* of locking lever 9 is in an intermediate position (position 2) where a portion of the body 9*b* of locking lever 9 engages lock member 7 and prevents lock member 7 from moving until the handle of locking lever 9 is moved into position 1. In the form shown, the handle 9*a* of locking lever 9 extends out from the holster at approximately a ninety degree (90°) angle as illustrated in FIG. 1 so that the handle 9*a* can easily and rapidly be moved from position 2 to position 1 as the user is drawing the firearm. Thus, the second lock position (i.e., position 2) provides added security that the firearm will not inadvertently be removed from the holster, but can be removed rapidly when desired. The third position (position 3) is when the handle 9*a* of locking lever 9 is in its furthest downward pointing position with respect to the holster and the body 9*b* of locking lever 9 fully engages lock member 7 and prevents removal of the firearm from the holster until the handle of locking lever 9 is moved to position 1. Thus, in the third position (or position 3) the locking lever handle 9*a* is positioned furthest from the reach of a user so that a very deliberate effort must be made to remove the firearm from the holster to provide even further security that the firearm will not be inadvertently removed from the holster even when making a drawing motion unlike how the locking lever 9 works in position 2.

The universal holster assembly according to the present invention also comprises an adjustable inclination assembly for adjusting a position of the holster with respect to the user's body or belt clip 44. The adjustable inclination assembly serves as a means for adjusting the inclination of the assembly with respect to the user's body or belt clip 44. In the form illustrated, two fasteners 5 and 42 hold a spherical pin 40 between two arched members allowing the holster to be rotated in a variety of directions or positioned in a variety of positions to allow the user to position the firearm into a preferred orientation with respect to the remainder of the belt holding the holster (not shown) and belt clip 44. In the form illustrated, the fasteners 5 and 42 are threaded bolts with mating nuts, which are positioned to pass laterally through the arched shaped members so that the fasteners are accessible from the front and/or rear of the holster without obstruction and, thereby, provide easy access for use by the user of the holster such as to tighten or loosen the fasteners so that the holster and/or firearm mounted therein may be held in position more or less forcefully, respectively. In this way, the two arch shaped structures form a clamp body that captures the spherical pin and allows the holster to be rotated in a plurality of directions and into a plurality of positions with respect to a holster belt clip.

The holster assembly further includes a system for adjusting its height on the belt, in order to adapt the assembly to the user's height. This system comprises a shaft 39 with three positions. A tightened position provides locking at the desired height, and a free position allows raising and lowering the assembly without releasing it from the belt. For storage, the holster may be conveniently removed from the belt by pulling the regulating shaft 39 to its end position (the third position), allowing the holster to be released from its engagement 44 to the belt. In the form illustrated, shaft 39 is orientated off to the side of engagement or belt clip 44 rather than in front of the belt clip 44 between the holster and clip so that the shaft 39 can be more easily grasped and operated or moved between its three positions. More particularly, the shaft 39 has a handle or knob portion that can easily be grasped and used to move the shaft 39 longitudinally between any of its three positions.

Figure 4:
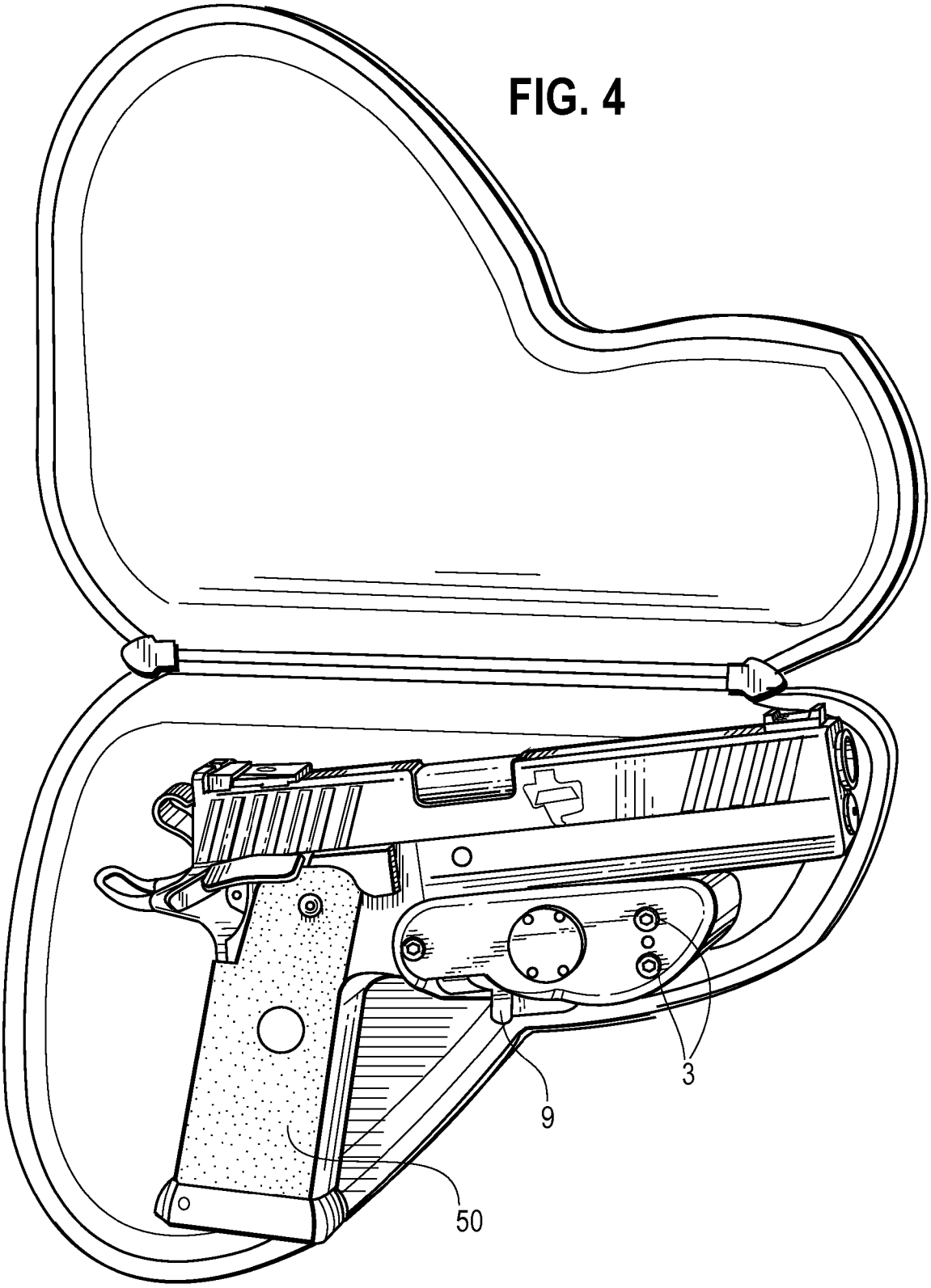
FIG. 4 is a perspective view of a firearm connected to the holster and illustrating an optional cover that may be used with the holster assembly.

As illustrated in FIG. 4, the holster assembly may further include an optional cover, such as soft gun case 50, to protect the firearm from natural elements such as environmental exposure (e.g., sun, weather, etc.) and external forces that may scratch or damage the firearm. In the form illustrated, the cover is designed to work without interfering with the operation of the holster and allows the firearm and holster to be removed from the belt engagement assembly when the height-regulating system is moved to the end position so that the firearm may be stored away using the holster as a trigger lock. Thus, a user may wear the covered firearm and holster while at a range or during a shooting competition and then remove the holstered firearm and cover from belt engagement 44 to safely store the firearm in a stored location using the holster as a trigger lock for the weapon.

All of the regulating systems have been designed and conceived to offer a fast, safe and versatile use of the equipment. For example, the holster may be configured to allow for the fastest form of removal of the firearm while still retaining protection against inadvertent removal or discharge of the firearm. In this form, the firearm is held in the holster via passive locks 7 and 24 only and not active lock 9, however, the firearm can be removed quickly from the holster using a standard drawing motion. Alternatively, the holster may be configured to secure the firearm in the holster using both the passive lock and the active lock 9, which requires the user to move the active lock from an intermediate, yet conveniently reached position while making his or her drawing motion. Still further, the holster may alternatively be configured to secure the firearm in the holster using both the passive lock and active lock, but having the active lock positioned in a harder-to-reach location that the active lock cannot be easily moved from while making his or her drawing motion and, thus, requires a more deliberate action to be taken to remove the firearm from the holster. In all of these configurations, the firearm is held by its trigger guard so that the holster prevents actuation of the trigger and, thereby, prevents inadvertent firing of the firearm. Another purpose of the present invention is to provide a means by which a single product is sufficient, even if the user happens to change firearms. The same holster may be used by making the necessary adjustments to a different gun.

It should also be appreciate that associate methods for manufacturing, assembling and adjusting firearm holsters like those discussed above are also contemplated herein as are methods for securing and releasing firearms. Thus, it is apparent that there has been provided, in accordance with the invention, a universal holster and methods relating to same that fully satisfy the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

The invention claimed is:

1. A holster assembly for holding a firearm on a user's body comprising:

a first passive locking device actuated by a weight of the firearm, upon insertion of the firearm into the holster;

a second passive locking device actuated by a spring, said first passive locking device and said second passive locking device being independent and functionally distinct from each other;

a height-regulating system to adjust a height of the assembly with respect to the user's body via a shaft with a knob that moves the shaft to three positions; and an adjustable inclination assembly that employs two arch shaped structures that capture a spherical pin via one or more threaded bolts to adjust a position of the holster with respect to the user's body.

2. The holster assembly of claim 1, wherein the first and second passive locks each include movable inserts that may be adjusted by respective first and second adjustment screws until the inserts touch an inside of the trigger guard so that the holster may securely hold the firearm.

3. The holster assembly of claim 2, wherein the first passive lock insert is adjusted by moving the first passive lock forward until the first adjustment screw is exposed, and the second passive lock insert is adjusted by moving the second passive lock backward until the second adjustment screw is exposed.

4. The holster assembly of claim 1, further comprising an active lock movable between at least three positions and including a lever having a handle and a body for movement of the active lock between the three positions, with the first position having the handle of the lever in its most upright position with respect to the remainder of the holster and the body of the lever does not engage or interfere with any portion of said first passive locking device, the second position having the handle of the lever in an intermediate position wherein a portion of the body of the lever engages said first passive locking device and prevents said first passive locking device from moving until the handle of the lever is moved into said first position, and the third position having the handle of the lever in its further downward pointing position with respect to the holster as well as further from reach of a user and the body of the lever fully engages the first passive locking device and prevents removal of the firearm from the holster until the handle of the lever is moved to said first position.

5. The holster assembly of claim 1, wherein said three positions of the height-regulating system's shaft comprise: a tightened position that secures the holster at a desired height with respect to a belt engagement assembly; a free position that allows raising and lowering the assembly with respect to the belt engagement assembly without releasing the holster from the belt engagement assembly; and an end position that allows the holster to be released from the belt engagement assembly.

* * * * *